US010017429B2

(12) United States Patent
Daniels et al.

(10) Patent No.: US 10,017,429 B2
(45) Date of Patent: Jul. 10, 2018

(54) METHODS OF REDUCING IGNITION SENSITIVITY OF ENERGETIC MATERIALS

(71) Applicants: BATTELLE ENERGY ALLIANCE, LLC., Idaho Falls, ID (US); Texas Tech University System, Lubbock, TX (US)

(72) Inventors: Michael A Daniels, Idaho Falls, ID (US); Ronald J Heaps, Idaho Falls, ID (US); Michelle Pantoya, Lubbock, TX (US)

(73) Assignees: Battelle Energy Alliance, LLC, Idaho Falls, ID (US); Texas Tech University System, Lubbock, TX (US)

( * ) Notice: Subject to any disclaimer, the term of this patent is extended or adjusted under 35 U.S.C. 154(b) by 105 days.

(21) Appl. No.: 14/811,703

(22) Filed: Jul. 28, 2015

(65) Prior Publication Data

US 2016/0031769 A1 Feb. 4, 2016

Related U.S. Application Data

(63) Continuation-in-part of application No. 14/050,642, filed on Oct. 10, 2013, now Pat. No. 9,481,614.

(51) Int. Cl.
*C06B 33/00* (2006.01)
*C06B 21/00* (2006.01)
(Continued)

(52) U.S. Cl.
CPC ..... *C06B 21/0091* (2013.01); *C06B 23/009* (2013.01); *C06B 27/00* (2013.01);
(Continued)

(58) Field of Classification Search
USPC ..... 149/19.3, 37, 41, 46, 109.2, 109.4
See application file for complete search history.

(56) References Cited

U.S. PATENT DOCUMENTS 4,917,017 A 4/1990 Beltz
4,925,600 A 5/1990 Hommel et al.
(Continued)

FOREIGN PATENT DOCUMENTS

WO 8500364 A 1/1985
WO 2008082724 A2 7/2008

OTHER PUBLICATIONS

Poper et al., "Controlling the electrostatic discharge ignition sensitivity of composite energetic materials using carbon nanotube additives," Journal of Electrostatics, 72, 2014, pp. 428-432.
(Continued)

*Primary Examiner* — James E McDonough
(74) *Attorney, Agent, or Firm* — TraskBritt

(57) ABSTRACT

An energetic material comprising an elemental fuel, an oxidizer or other element, and a carbon nanofiller or carbon fiber rods, where the carbon nanofiller or carbon fiber rods are substantially homogeneously dispersed in the energetic material. Methods of tailoring the electrostatic discharge sensitivity of an energetic material are also disclosed. Energetic materials including the elemental fuel, the oxidizer or other element, and an additive are also disclosed, as are methods of reducing ignition sensitivity of the energetic material including the additive. The additive is combined with the elemental fuel and a metal oxide to form the energetic material. The energetic material is heated at a slow rate to render inert the energetic material to ignition while the energetic material remains ignitable when heated at a fast rate.

18 Claims, 9 Drawing Sheets

(51) Int. Cl.
*C06B 23/00* (2006.01)
*C06B 27/00* (2006.01)
*C06C 9/00* (2006.01)

(52) U.S. Cl.
CPC ..... *C06B 33/00* (2013.01); *C06B 23/005* (2013.01); *C06C 9/00* (2013.01)

(56) References Cited

U.S. PATENT DOCUMENTS 5,468,313 A * 11/1995 Wallace, II ..... C06B 21/0058 149/53
5,485,786 A 1/1996 Hesse et al.
5,717,159 A 2/1998 Dixon et al.
6,217,788 B1 4/2001 Wucherer et al.
7,578,895 B1 8/2009 Chen et al.
7,614,348 B2 11/2009 Truitt et al.
7,632,364 B1 12/2009 Jouet et al.
7,754,036 B1 7/2010 Newman et al.
7,951,248 B1 5/2011 Fallis et al.
8,007,608 B1 8/2011 Herbage et al.
8,048,241 B1 11/2011 Davison
8,172,965 B2 5/2012 Daoud et al.
8,257,523 B1 9/2012 Puszynski et al.
8,425,702 B2 4/2013 Nicolich et al.
8,454,770 B1 6/2013 Erickson et al.
8,465,606 B1 * 6/2013 Redding ..... C06B 21/0041 149/109.6
2006/0011083 A1 * 1/2006 Perry ..... B82Y 30/00 102/205
2006/0060272 A1 3/2006 Naud et al.
2006/0113014 A1 6/2006 Puszynski et al.
2006/0266204 A1 11/2006 Givens et al.
2007/0095445 A1 * 5/2007 Gangopadhyay ..... C06B 33/00 149/37
2010/0009165 A1 1/2010 Patel et al.
2011/0027547 A1 * 2/2011 Xun ..... B32B 15/01 428/201
2011/0240184 A1 10/2011 Higa et al.
2011/0240185 A1 10/2011 Higa et al.
2011/0240186 A1 10/2011 Higa et al.
2012/0060984 A1 3/2012 Gogotsi et al.
2012/0060985 A1 3/2012 Ashcroft et al.
2012/0232189 A1 9/2012 Cahill, Jr. et al.
2014/0260185 A1 9/2014 Seidner et al.
2015/0101719 A1 4/2015 Daniels et al.

OTHER PUBLICATIONS

Shaw et al., "Detonation models of fast combustion waves in nanoscale Al—MoO3 bulk powder media," Combustion Theory and Modelling, 17:1, 2013, pp. 25-39.
Weir et al., "Electrostatic discharge sensitivity and electrical conductivity of composite energetic materials," Journal of Electrostatics, 71, 2013, pp. 77-83.
Babrauskas et al., "Heat Release Rate: The Single Most Important Variable in Fire Hazard," Fire Safety Journal, 18, 1992, pp. 255-272.
Hunt et al., "Ignition dynamics and activation energies of metallic thermites: From nano- to micron-scale particulate composites," Journal of Applied Physics, 98, 2005, pp. 034909-1-034909-8.
Collins et al., "Ignition sensitivity and electrical conductivity of an aluminum fluoropolymer reactive material with carbon nanofillers," Combustion and Flame, 162, 2015, pp. 1417-1421.
Rosser et al., "The Kinetics of Decomposition of Liquid Ammonium Nitrate," J. Phys. Chem., vol. 67, 1963, pp. 1753-1757.
Levitas et al., "Mechanochemical mechanism for fast reaction of metastable intermolecular composites based on dispersion of liquid metal," Journal of Applied Physics, 101, 2007, pp. 083524-1-083524-20.
Collins et al., "Piezoelectric Ignition of Nanocomposite Energetic Materials," Journal of Propulsion and Power, vol. 30, No. 1, Jan.-Feb. 2014, pp. 15-18.
Bockmon et al., "Combustion velocities and propagation mechanisms of metastable interstitial composites," Journal of Applied Physics, 98, 2005, pp. 064903-1-064903-7.
Keenan et al., "Synergistic Catalysis of Ammonium Nitrate Decomposition," Journal of the American Chemical Society, 91:12, Jun. 4, 1969, pp. 3168-3171.
Collins et al., "Synthesizing aluminum particles towards controlling electrostatic discharge ignition sensitivity," Journal of Electrostatics, 72, 2014, pp. 28-32.
Oxley et al., "Thermal Decomposition of Ammonium Nitrate-Based Composites," Thermochimica Acta, 153, 1989, pp. 269-286.
Brill et al., "Thermal Decomposition of Energetic Materials 58. Chemistry of Ammonium Nitrate and Ammonium Dinitrarnide Near the Burning Surface Temperature," Combustion and Flame, 92, 1993, pp. 178-186.
Koch, E.-C., "Metal-Fluorocarbon-Pyrolants: III. Development and Application of Magnesium/Teflon/Viton (MTV)," Propellants, Explosives, Pyrotechnics, vol. 27, No. 5, pp. 262-266, Nov. 2002.
Kuwahara, et al., "Combustion and sensitivity characteristics of Mg/TF pyrolants," Propellants, Explosives, Pyrotechnics, vol. 202, pp. 198-202, 2004.
Mutiso et al., "Simulations and generalized model of the effect of filler size dispersity on electrical percolation in rod networks," Physical Review B, vol. 86, No. 21, p. 214306, Dec. 2012.
Sandler et al., "Ultra-low electrical percolation threshold in carbon-nanotube-epoxy composites," Polymer, vol. 44, No. 19, pp. 5893-5899, Sep. 2003.
Sandler et al., "Development of a dispersion process for carbon nanotubes in an epoxy matrix and the resulting electrical properties," Polymer, vol. 40, pp. 5967-5971, 1999.
Siegert et al., "Reduced-Sensitivity Nanothermites Containing Manganese Oxide Filled Carbon Nanofibers," J. Phys. Chem. C 2010, 114, 19562-19568.
Weir et al., "The role of aluminum particle size in electrostatic ignition sensitivity of composite energetic materials," Combustion and Flame, May 2013.
Balberg et al., •Excluded volume and its relation to the onset of percolation,• Physical Review B, vol. 30, No. 7, pp. 3933•3943, 1984.
Bao et al., "Effects of the dispersion state and aspect ratio of carbon nanotubes on their electrical percolation threshold in a polymer," Journal of Applied Polymer Science, vol. 128, No. 1, pp. 735-740, Apr. 2013.
Densmore et al., "Thermal imaging of nickel-aluminum and aluminum-polytetrafluoroethylene impact initiated combustion," Journal of Applied Physics, vol. 112, No. 8, p. 084911, 2012.

* cited by examiner

Time=O sec Time=0.0001 sec Time=0.0002 sec Time=0.0003 sec

Time=0 sec Time=0.0003 sec Time=0.0006 sec Time=0.001 sec

Time=0 sec Time=0.0004 sec Time=0.0008 sec Time=0.0012 sec

METHODS OF REDUCING IGNITION SENSITIVITY OF ENERGETIC MATERIALS

CROSS-REFERENCE TO RELATED APPLICATION

This application is a continuation-in-part of U.S. patent application Ser. No. 14/050,642 entitled ENERGETIC MATERIALS AND METHODS OF TAILORING ELECTROSTATIC DISCHARGE SENSITIVITY OF ENERGETIC MATERIALS, filed on Oct. 10, 2013, now U.S. Pat. No. 9,481,614 issued Nov. 1, 2016, the disclosure of which application is incorporated by reference herein in its entirety.

STATEMENT REGARDING FEDERALLY SPONSORED RESEARCH OR DEVELOPMENT

This invention was made with government support under Contract Number DE-AC07-05ID14517 awarded by the United States Department of Energy. This invention was also made with government support Contract Number W911NF-11-1-0439 awarded by the Army Research office. The government has certain rights in the invention.

TECHNICAL FIELD

The disclosure, in various embodiments, relates generally to methods of reducing electrostatic discharge (ESD) sensitivity and/or ignition sensitivity of energetic materials and to the energetic materials. More specifically, the disclosure, in various embodiments, relates to energetic materials that include a carbon nanofiller, to methods of forming such energetic materials, and to methods of tailoring the ESD of such energetic materials. The disclosure, in various other embodiments, relates to methods of reducing ignition sensitivity of energetic materials that include an additive, and to energetic materials including the additive.

BACKGROUND

Energetic materials, especially those used as first-fire mixes, are susceptible to unintentional ESD initiation, which is not desired due to risk to person, property, or mission. However, ESD is difficult to eliminate in real-world situations because the amount of energy required to initiate an energetic material by ESD is usually several of orders of magnitude less than the amount of energy used to initiate the energetic material by other modes of initiation, such as heat, impact, or friction. It is also difficult to reduce the ESD sensitivity while maintaining desired modes of initiation and the desired performance of the energetic material. Accidental ESD initiation is problematic with thermite compositions, such as aluminum/copper oxide compositions, and intermetallic compositions, such as aluminum/nickel compositions. Thermite and intermetallic compositions are susceptible to accidental initiation by ESD since the fuels and oxidizers are usually in powder form. The addition of a fluoropolymer, such as VITON®, or alumina to the energetic material has also been tested. However, the exothermic reaction was affected and the ESD sensitivity was not greatly improved.

Energetic materials are also susceptible to unintentional ignition when exposed to heat, such as the heat produced by a fire. For instance, the energetic material may be unintentionally exposed to heat during storage or transportation, such as if a vehicle, vessel, building, or other containment including the energetic material catches fire. During a fire, the energetic material is exposed to a relatively low temperature for an extended period of time compared to the temperature and duration produced by the ignition of the energetic material, which may be on the order of seconds or milliseconds. The heating rate of the energetic material when exposed to a fire is also much slower than the heating rate of the energetic material when ignited. Nevertheless, the heat from the fire can be sufficient to ignite the energetic material, causing damage to nearby facilities and personnel. Furthermore, if the energetic material is contained in a confinement, such as in a case, the energetic material may react violently when heated, producing fragments (shrapnel) that cause damage to adjacent facilities and personnel. To reduce the sensitivity of the energetic material to unintentional ignition, the amount of the energetic material being stored or transported may be limited, or the energetic material may be carefully guarded during storage or transport.

A composite energetic material (CEM) is a class of energetic materials that includes fuel and oxidizer particles that are highly exothermic upon ignition. CEMs are also referred to in the art as thermites, reactive materials, and pyrotechnics. If the particle size of the components is on the nanoscale, then the CEMs may also be referred to as nanothermites, superthermites, metastable intermolecular composites, metastable interstitial composites, or metastable nanoenergetic composites. Since the reaction of CEMs is diffusion limited, the CEMs may be tailored toward specific applications by adjusting the compounds used as the fuel and oxidizer, unlike conventional explosive compositions whose reactivity is kinetically limited by the monomolecular crystal structure. To reduce the mechanical sensitivity of a manganese oxide/aluminum composition, carbon nanofibers have been filled with the manganese oxide. The manganese oxide and the aluminum are, thus, alleged to be separated from one another and the composition exhibited reduced mechanical sensitivity (friction sensitivity) compared to a manganese oxide/aluminum composition lacking the carbon nanofibers. The filled carbon nanofiber composition also had a decrease in ESD sensitivity compared to the manganese oxide/aluminum composition lacking the carbon nanofibers. The filled carbon nanofiber composition was also compared to a composition including manganese oxide and aluminum mixed with unfilled carbon nanofibers. The filled carbon nanofiber composition had an ESD sensitivity of 35 mJ while the unfilled carbon nanofiber composition had an ESD sensitivity of 1800 mJ.

As the use of CEMs increases, safety concerns relating to their ignition sensitivity and to their ESD sensitivity increase. To improve the safety of energetic materials, it would be desirable to reduce their potential for unintentional ignition and ESD sensitivity.

BRIEF SUMMARY

An embodiment of the disclosure includes an energetic material comprising an elemental fuel, an oxidizer or at least one other element, and a carbon nanofiller. The carbon nanofiller is substantially homogeneously dispersed in the energetic material.

Another embodiment of the disclosure includes a method of tailoring ESD sensitivity of an energetic material. The method comprises substantially homogeneously dispersing a carbon nanofiller with an elemental fuel and an oxidizer or at least one other element to form an energetic material.

Yet another embodiment of the disclosure includes an energetic material comprising an elemental fuel, an oxidizer, and carbon fiber rods. The carbon fiber rods are substantially homogeneously dispersed in the energetic material.

Still yet another embodiment includes a method of reducing ignition sensitivity of an energetic material. The method comprises combining an additive, an elemental fuel, and a metal oxide to form an energetic material. The energetic material is heated at a slow rate to render inert the energetic material to ignition while the energetic material remains ignitable when heated at a fast rate.

Still yet another embodiment includes a method of reducing ignition sensitivity of an energetic material. The method comprises heating an energetic material at a slow rate of less than about 100 degrees per minute. The energetic material comprises an elemental fuel, a metal oxide, and an additive. The additive is selected from the group consisting of ammonium nitrate, aluminum stearate, copper carbonate, lithium 12-hydroxystearate, strontium oxalate, sulfur, zinc peroxide, zinc stearate, and combinations thereof. The energetic material previously heated at the slow rate is heated at a fast rate of greater than or equal to about 100 degrees per minute and does not ignite.

Another embodiment includes an energetic material comprising an elemental fuel, a metal oxide, and ammonium nitrate. The energetic material is formulated to become inert when heated at a rate of less than about 100 degrees per minute. The energetic material is formulated to ignite when heated at a rate of greater than or equal to about $1\times10^6$ degrees per minute and when not first heated at the rate of less than about 100 degrees per minute.

DETAILED DESCRIPTION

Figure 1:
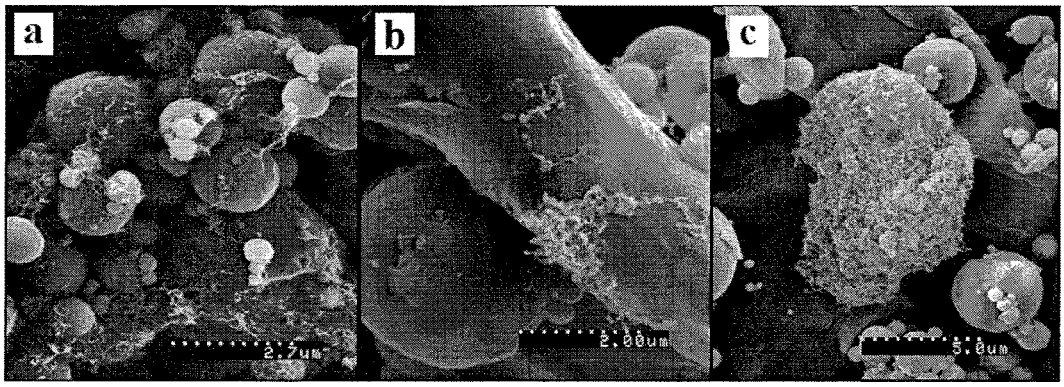
FIG. 1, Panels a-c, are scanning electron microscopy (SEM) images of energetic materials according to embodiments of the disclosure.

Energetic materials are disclosed that include a thermite composition, an intermetallic composition, or a pyrotechnic composition. A carbon nanofiller, an additive, or a combination thereof is also present in the energetic material. The energetic material has decreased electrostatic discharge sensitivity (ESD), decreased ignition sensitivity when heated at a slow rate, or both decreased ESD sensitivity and ignition sensitivity when heated at the slow rate. However, when heated at a fast rate, the energetic material exhibits comparable energetic performance to that of an energetic material lacking the additive. Methods of decreasing the ESD sensitivity, or the ignition sensitivity when heated at the slow rate are also disclosed.

The carbon nanofiller, when present, is substantially homogeneously dispersed in the energetic material and is present in an amount that provides sufficient electrical connections through the energetic material to dissipate electrostatic discharge (ESD). However, the amount of carbon nanofiller does not negatively affect the energetic performance of the energetic material, or other (e.g., non-ESD) modes of initiation. Thus, the energetic material may be initiated by a desired mode of initiation and yet may exhibit a reduced sensitivity to ESD initiation. The energetic material is more resistant to initiation by ESD and has a reduced risk of accidental initiation by ESD.

The additive, when included in the energetic material, is present at an amount that reduces the sensitivity of the energetic material to unintentional ignition, such as that caused when the energetic material is heated at the slow rate. However, the amount of the additive does not negatively affect the energetic performance of the energetic material when the energetic material is heated at the fast rate, such as to heat produced by conventional ignition conditions. Thus, the energetic material may be selectively ignited when subjected to conventional ignition conditions while being insensitive to ignition when heated at the slow rate.

The energetic material may be a thermite composition, an intermetallic composition, or a pyrotechnic composition. If the energetic material is a thermite composition, the thermite composition includes an elemental fuel, an oxidizer, and one or more of the carbon nanofiller or the additive. If the energetic material is an intermetallic composition, the intermetallic composition includes aluminum as the elemental fuel, at least one other element, and one or more of the carbon nanofiller or the additive. The carbon nanofiller or additive may be used in any energetic material that is sensitive to ESD initiation or that is sensitive to unintentional ignition when heated at the slow rate. Thus, energetic materials may be tailored to be less sensitive to ESD initiation while maintaining their energetic performance and initiation by other modes of initiation, such as by mechanical, thermal, impact, friction, or percussion. The energetic materials may also be less sensitive to unintentional ignition when heated at the slow rate yet maintain their ignitability when subjected to conventional ignition conditions. Thus, the energetic materials may be safely handled, stored, and transported compared to energetic materials lacking the carbon nanofiller or additive.

As used herein, the term "carbon nanofiller" means and includes a carbon material having at least one dimension (e.g., a diameter or thickness) less than or equal to about 100 nanometers. The carbon nanofiller may exhibit a cylindrical (e.g., tubular) morphology, such as carbon nanotubes (CNTs), or a platelet morphology, such as graphene nanoplatelets (GNPs). If the carbon nanofiller includes carbon nanotubes (CNTs), the diameter of the carbon nanotubes may be less than about 100 nm. If the carbon nanofiller includes graphene nanoplatelets (GNPs), the thickness of the graphene nanoplatelets may be less than about 100 nm and the diameter may be less than about 100 μm.

As used herein, the term "additive" means and includes a chemical compound having a thermal decomposition temperature that is below an autoignition temperature of the energetic material.

As used herein, the term "slow rate" means and includes an event, condition, or stimulus that produces energy, e.g., heat, and where the heat is transferred to the energetic material at a rate of less than about 100 degrees per minute (DPM).

As used herein, the term "fast rate" means and includes an event, condition, or stimulus that produces energy, e.g., heat, and where the heat is transferred to the energetic material at a rate of greater than or equal to about 100 DPM, such as from greater than or equal to about 100 DPM to greater than or equal to about $1\times10^6$ degrees per minute (DPM).

As used herein, the term "thermite composition" means and includes a composition having the elemental fuel, an oxide or a fluoropolymer as the oxidizer, and the one or more of the carbon nanofiller or the additive. When initiated, the elemental fuel chemically reduces the oxidizer, resulting in a highly exothermic reduction-oxidation reaction. For instance, if the oxidizer is a metal oxide, the elemental fuel is oxidized and the metal oxide is reduced to metal upon initiation of the energetic material.

As used herein, the term "elemental fuel" means and includes a metal, metalloid, alkali metal, alkaline earth, lanthanide, or actinide element. The elemental fuel may include, but is not limited to, aluminum, boron, beryllium, hafnium, lanthanum, lithium, magnesium, neodymium, tantalum, thorium, titanium, yttrium, zirconium, or combinations thereof.

As used herein, the term "intermetallic composition" means and includes a composition having aluminum as the elemental fuel, the at least one other element, and the one or more of the carbon nanofiller or the additive. The at least one other element is a non-metal, metal, metalloid, alkali metal, alkaline earth, lanthanide, or actinide element including, but not limited to, boron, carbon, calcium, cerium, cobalt, chromium, copper, iron, lanthanum, lithium, manganese, nickel, palladium, praseodymium, platinum, plutonium, sulfur, tantalum, titanium, uranium, vanadium, zirconium, or combinations thereof. The at least one other element may react with the aluminum to form an alloy upon initiation of the energetic material. As the aluminum and at least one other element react, exothermic energy is produced. The intermetallic composition may include a metal, metalloid, alkali metal, alkaline earth, lanthanide, or actinide element other than aluminum as the elemental fuel.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

The elemental fuel may have an average particle size of between about 20 nm and about 100 μm, such as between about 20 μm and about 70 μm, or between about 20 μm and about 50 μm. By way of example, the elemental fuel may have an average particle size of between about 20 nm and about 20 μm. In one embodiment, the elemental fuel is aluminum. In another embodiment, the elemental fuel is aluminum having an average particle size distribution of between about 3 μm and about 4.5 μm. An additional, optional, component of the energetic material may also function as a fuel, in combination with the elemental fuel. The optional fuel component may be an organic compound including, but not limited to, trinitrotoluene (TNT), hexogen (RDX), octogen (HMX), hexaazaisowurtzitane (CL-20), or hydroxyl-terminated polybutadiene (HTPB). However, when the organic compound is present in the energetic material, the organic component is present in combination with one of the above-mentioned elemental fuels.

The oxidizer may be an oxide, a perchlorate, a permanganate, a nitrate, a chloride, a fluoropolymer, or combinations thereof. Examples of oxides include, but are not limited to, a silver oxide (AgO, $Ag_2O$), a boron oxide ($B_2O_3$), a bismuth oxide ($Bi_2O_3$), a cobalt oxide (CoO, $Co_3O_4$), a chromium oxide ($Cr_2O_3$), a copper oxide (CuO, $Cu_2O$), an iron oxide ($Fe_2O_3$, $Fe_3O_4$), a mercury oxide (HgO), an iodide oxide ($I_2O_5$), a manganese oxide ($MnO_2$), a molybdenum oxide ($MoO_3$), a niobium oxide ($Nb_2O_3$), a nickel oxide (NiO, $Ni_2O_3$), a lead oxide (PbO, $PbO_2$, $Pb_3O_4$), a palladium oxide (PdO), a tin oxide (SnO, $SnO_2$), a tantalum oxide ($Ta_2O_5$), a titanium oxide ($TiO_2$), a uranium oxide ($U_3O_8$), a vanadium oxide ($V_2O_5$), a tungsten oxide ($WO_2$, $WO_3$), or combinations thereof. Examples of perchlorates include, but are not limited to, potassium perchlorate, sodium perchlorate, ammonium perchlorate, or combinations thereof. Examples of permanganates include, but are not limited to, potassium permanganate, ammonium permanganate, sodium permanganate, or combinations thereof. Examples of nitrates include, but are not limited to, potassium nitrate, barium nitrate, ammonium nitrate, or combinations thereof. One example of a chloride includes, but is not limited to, potassium chloride. The oxidizer may also be a silicon oxide (SiO, $SiO_2$), or a silicon oxide in combination with at least one of the previously mentioned oxidizers. The oxide, perchlorate, or permanganate may have an average particle size of between about 20 nm and about 100 μm. If, however, the energetic material includes aluminum and CNTs, the oxidizer is not manganese oxide.

The fluoropolymer may include, but is not limited to, polytetrafluoroethylene (PTFE), a copolymer of hexafluoropropylene and vinylidene fluoride, a terpolymer of tetrafluoroethylene, hexafluoropropylene, and vinylidene fluoride, or combinations thereof. The fluoropolymer may have an average particle diameter of less than about 100 such as less than about 50 μm.

In one embodiment, the oxidizer is PTFE. In another embodiment, the oxidizer is copper(II) oxide.

The carbon nanofiller may be electrically conductive and may remain substantially inert (e.g., substantially nonreactive with the elemental fuel and/or oxidizer) during the exothermic reaction produced upon initiation of the energetic material. The carbon nanofiller may account for only a small percentage of the total amount of the energetic material, such as less than or equal to about 25% by volume of the energetic material. Thus, the overall combustion performance of the energetic material is not significantly affected by the presence of the carbon nanofiller. The carbon nanofiller may be carbon nanotubes (CNTs), graphene nanoplatelets (GNPs), or combinations thereof. The carbon nanotubes may be single-walled carbon nanotubes, multi-walled carbon nanotubes, or combinations thereof having a diameter of less than about 50 nm. The graphene nanoplatelets may exhibit a platelet morphology having a high aspect ratio (a thickness of less than about 50 nm and a diameter of less than about 100 μm). The carbon nanofiller may be commercially available, such as from Alfa Aesar (Ward Hill, Mass.) or Graphene Supermarket (Calverton, N.Y.). While CNTs and GNPs are described herein, the morphology of the carbon nanofiller is not limited to tubes and platelets. Other morphologies may be used, such as spherical, ellipsoidal, or other known morphologies.

In one embodiment, the carbon nanofiller includes CNTs having an outer diameter of from about 3 nm to about 20 nm, an inner diameter of from about 1 nm to about 3 nm, and a length of from about 0.1 μm to about 10 In another embodiment, the carbon nanofiller includes GNPs having a thickness of about 8 nm and a length of from about 0.15 μm to about 3.0 μm.

In one embodiment, the energetic material includes aluminum, PTFE, and CNTs. In another embodiment, the energetic material includes aluminum, cupric oxide, and CNTs.

The carbon nanofiller may be present in the energetic material at from about 0.5% by volume to about 25% by volume, such as from about 0.8% by volume to about 15% by volume, from about 1% by volume to about 10% by volume, or from about 1% by volume to about 5% by volume. The carbon nanofiller may be present in an amount that exceeds the percolation threshold of the energetic material and provides sufficient electrical connections in the energetic material to dissipate ESD rather than initiate the energetic material. However, the carbon nanofiller may be present at a minimal amount so that energetic performance of the energetic material is not decreased but yet the desired level of ESD protection is achieved. In addition, the presence of the carbon nanofiller may not significantly affect the desired mode of initiating the energetic material or the reaction rate of the energetic material. The amount of carbon nanofiller in the energetic material may be selected depending on the particle size, particle shape, and chemistry of the other components of the energetic material, such as the elemental fuel, oxidizer, other element, or optional components.

The elemental fuel and the oxidizer, or the elemental fuel and the at least one other element, may, together, account for the balance of the energetic material, such as from about 20% by volume to about 99.5% by volume of the energetic material. The elemental fuel may account for from about 20% by volume to about 99.5% by volume of the energetic material and the oxidizer may account for from about 20% by volume to about 99.5% by volume of the energetic material. The elemental fuel and the oxidizer may be present in the energetic material at a fuel/oxidizer equivalence ratio (F/O ER) of from about 0.8 to about 6.0, such as from about 0.8 to about 1.5, from about 1.0 to about 1.5, from about 3.5 to about 6.0, or from about 4.0 to about 5.5. As known in the art, the F/O ER is the ratio of the fuel/oxidizer mass ratio in the actual energetic material to the fuel/oxidizer mass ratio in a stoichiometric energetic material (see Reaction 1). The relative amounts of the elemental fuel and the oxidizer may be selected such that the energetic material is fuel rich (having an F/O ER greater than 1), stoichiometric (having an F/O ER equal to 1), or fuel lean (having an F/O ER less than 1). In one embodiment, the energetic material has an F/O ER between about 1.0 and about 1.5. In another embodiment, the energetic material has an F/O ER between about 4.0 and about 5.5.

The energetic material may be produced by combining the carbon nanofiller and/or the additive, the elemental fuel, the oxidizer or other element, and any optional components. The carbon nanofiller and/or the additive may be combined with the elemental fuel and oxidizer or other element by conventional mixing processes, such as by sonication, mechanical wet mixing, or dry mixing processes. For instance, the elemental fuel and oxidizer or other element may be combined, and then the carbon nanofiller and/or the additive added to the elemental fuel/oxidizer or elemental fuel/other element. Alternatively, the carbon nanofiller and/or the additive, elemental fuel, and oxidizer or other element may be combined in a single process act. Solvents or processing aids may, optionally, be used during the mixing. After mixing, the carbon nanofiller and/or the additive may be substantially homogeneously dispersed throughout the energetic material, the term "substantially homogeneously" indicating the potential for minute volumes of energetic material having a slightly more or less homogeneous composition due to limits of even the most effective mixing techniques. Once mixed, any solvents or processing aids may be removed by conventional techniques, producing the energetic material.

The resulting energetic material may include the elemental fuel in contact with the oxidizer or the other element, and the carbon nanofiller and/or the additive dispersed throughout the elemental fuel and oxidizer or the other element. As shown in FIG. 1, Panels a and b, the carbon nanofiller is dispersed throughout the elemental fuel and oxidizer or the other element. Any openings in the carbon nanofiller, such as openings in the CNTs, may be substantially free of the elemental fuel and of the oxidizer or the element. In other words, each of the elemental fuel and oxidizer or other element does not enter the openings in the CNTs to any appreciable extent. By way of example, the CNTs may include less than 1% by volume of the elemental fuel or the oxidizer or other element in its tubular structure. The resulting energetic materials retain their original energetic properties, other than being insensitive to ESD initiation and/or to unintentional ignition.

Without being bound by any theory, it is believed that the carbon nanofiller in the energetic material may reduce the ESD sensitivity by exceeding the percolation threshold of the energetic material. By utilizing carbon fillers that are nanometer-sized, better percolation of the energetic material may be achieved. The carbon nanofiller may provide a conductive path (e.g., network) between the elemental fuel and the oxidizer or other element of the energetic material. Thus, the carbon nanofiller may provide sufficient electrical connections in the energetic material to dissipate the ESD, rather than the ESD initiating the energetic material. Even at high ESD levels, such as greater than or equal to 100 μS/cm, the ESD is dissipated through the energetic material rather than causing initiation of the energetic material. It is also believed that using the CNTs as the carbon nanofiller, or a combination of the CNTs and GNPs, creates percolation at a lower volumetric percentage than using GNPs alone.

Energetic materials are also disclosed that include carbon fillers having a larger size, such as carbon fiber rods. The carbon fiber rods may be conductive and may be used in the energetic materials instead of, or in combination with, the carbon nanofillers described above. The carbon fiber rods may be milled carbon fibers having a length of less than about 450 μm, such as from about 50 μm to less than about 450 μm, such as those commercially available from Toho Tenax America (Rockwood, Tenn.) under the TENAX® tradename. The carbon fiber rods may account for from about 0.5% by volume to about 10% by volume of the energetic material. By way of example, the carbon fiber rods may be used instead of the carbon nanofillers described above. For instance, the energetic material may include a fuel, oxidizer, and the carbon fiber rods. In one embodiment, the energetic material includes aluminum, potassium perchlorate, and the carbon fiber rods.

By including the carbon nanofiller in the energetic material, the sensitivity of the energetic material to ESD initiation may be tailored. By tailoring the reactivity of the energetic material to ESD, the performance properties of the energetic material may be tailored for specific applications. Thus, energetic materials having increased ESD sensitivity may be produced for use in applications where ESD sensitivity is problematic. However, an energetic material may be tailored to exhibit a decreased ESD sensitivity for use in applications where ESD sensitivity is not problematic.

The additive used in the energetic material to decrease the ignition sensitivity may have a decomposition temperature that is below an autoignition temperature of the energetic material, such as a decomposition temperature of less than or equal to about 300° C., such as less than or equal to about 290° C. The difference between the decomposition temperature of the additive and the autoignition temperature of the energetic material may be maximized (i.e., the difference is sufficiently large) so that the additive decomposes when heated at the slow rate before the energetic material is heated to its autoignition temperature. By way of example only, the autoignition temperature of an energetic material including Al and CuO may be about 660° C. and, therefore, the difference between the decomposition temperature of the additive and the autoignition temperature of the energetic material may be between about 370° C. and about 450° C. The decomposition of the additive may prevent the energetic material from subsequently igniting. If, however, the energetic material is not heated at a rate sufficient to decompose the additive, the energetic material may be ignited as desired when subjected to conventional ignition conditions. The energetic material including the additive may have comparable or increased energetic performance when ignited by conventional ignition conditions compared to an energetic material lacking the additive.

When exposed to a fire, which heats the energetic material at the slow rate, the energetic material including the additive may not ignite. The slow rate at which the energetic material is heated is significantly less than the heating rate sufficient to ignite the energetic material. For instance, the energetic material may be heated at a slow rate of less than about 100 degrees per minute (DPM) while a fast rate, sufficient to ignite the energetic material, is greater than or equal to about 100 DPM. The slow rate may be less than about 100 DPM, such as from about 1 DPM to less than about 100 DPM, from about 5 DPM to about 50 DPM, from about 5 DPM to about 40 DPM, from about 5 DPM to about 30 DPM, from about 5 DPM to about 20 DPM, from about 5 DPM to about 15 DPM, from about 5 DPM to about 95 DPM, from about 10 DPM to about 90 DPM, from about 20 DPM to about 90 DPM, from about 30 DPM to about 90 DPM, from about 40 DPM to about 90 DPM, from about 50 DPM to about 90 DPM, from about 60 DPM to about 90 DPM, from about 70 DPM to about 90 DPM, or from about 80 DPM to about 90 DPM. The fast rate may be greater than or equal to about 100 DPM, such as from greater than or equal to about 100 DPM to greater than or equal to about $1\times10^6$ DPM. When heated at the slow rate of heat transferred from the fire, the additive in the energetic material may decompose, rendering the energetic material inert (i.e., not reactive with other components of the energetic material) rather than igniting the energetic material. Alternatively, the additive may react with the fuel of the energetic material in a low-energy reaction that does not generate sufficient heat to ignite the energetic material. If the energetic material is subsequently heated at the fast rate, the energetic material does not ignite. However, when the energetic material is directly heated at the fast rate, such as that produced by conventional ignition (i.e., initiation) conditions, the energetic material may ignite as desired. Thus, the energetic material may be tailored to ignite when heated at the fast rate associated with conventional ignition (i.e., initiation) conditions while remaining insensitive to unintentional ignition conditions when heated at the slow rate, such as that produced by the fire.

The additive may be selected to provide the energetic material with comparable energetic performance when ignited by conventional ignition conditions while preventing ignition when heated at the slow rate. The additive may be ammonium nitrate (AN), aluminum stearate, copper carbonate, lithium 12-hydroxystearate, strontium oxalate, sulfur, zinc peroxide, zinc stearate, or combinations thereof. In one embodiment, the additive is AN. The decomposition kinetics of AN have been studied. As long as chloride and some transition metal ions (e.g., chromium and copper) are not present, the heat liberated by decomposition of the AN in an energetic material including aluminum, copper oxide, and AN is about 36 kJ/mole, which is below the energy required to ignite the energetic material. Many aluminum-based energetic materials have an apparent activation energy of about 162 kJ/mole.

Without being bound by any theory, it is believed that decomposition of the additive causes the energetic material to become fuel rich (i.e., oxidizer poor), preventing ignition of the energetic material. Upon being heated at the slow rate, the additive decomposes before the autoignition temperature of the energetic material is reached, rendering the energetic material inert. If, however, no decomposition of the additive occurs and the energetic material is only heated at the fast rate, the energetic material includes sufficient oxidizer for the energetic material to ignite with conventional ignition conditions, i.e., stimuli.

The additive may be used in place of (i.e., replace) a portion of the oxidizer in the energetic material, maintaining the F/O ER of the energetic material. The additive may replace up to about 70% of the oxidizer in the energetic material, such as from about 5% to about 70% of the oxidizer, from about 5% to about 65% of the oxidizer, from about 10% to about 50% of the oxidizer, from about 20% to about 50% of the oxidizer, from about 30% to about 50% of the oxidizer, from about 35% to about 50% of the oxidizer, from about 40% to about 50% of the oxidizer, or from about 45% to about 50% of the oxidizer. In one embodiment, the additive replaces about 60% of the oxidizer. In another embodiment, the additive replaces about 50% of the oxidizer. In yet another embodiment, the additive replaces about 40% of the oxidizer.

The energetic materials including the carbon nanofiller and/or the additive may be used in pyrotechnics (e.g., fireworks), thermites, or intermetallics. By way of example only, the energetic materials including the carbon nanofiller and/or the additive may be used as energetic materials for micro-thrusters, high flame temperature compositions for welding and alloying metals, such as rail or electrical ground welding, primers in ordnance, or industrial and localized power generation applications.

The following examples serve to explain embodiments of the present disclosure in more detail. These examples are not to be construed as being exhaustive or exclusive as to the scope of this disclosure.

EXAMPLES

Example 1

Al/PTFE Energetic Materials Including CNTs, GNPs, or CNTs/GNPs

Energetic materials including aluminum and PTFE with different percentages of the carbon nanofiller were prepared. The energetic materials had an F/O ER of 1. Carbon nanotubes (CNTs) and graphene nanoplatelets (GNPs) were added to the energetic materials to determine the effect on electrical conductivity and ESD ignition sensitivity of the energetic material since there is a correlation between these properties. The carbon nanofiller included carbon nanotubes (CNTs), graphene nanoplatelets (GNPs), or combinations thereof. Multi-walled carbon nanotubes (CNTs) and graphene nanoparticles (GNPs) were used as the carbon nanofiller and were purchased from Alfa Aesar (Ward Hill, Mass.) and Graphene Supermarket (Calverton, N.Y.), respectively. As provided by the manufacturer, the CNTs had an outer diameter of 3 nm-20 nm, an inner diameter of 1 nm-3 nm, and a length of 0.1 μm-10 μm. As provided by the manufacturer, the GNPs were flakes having a thickness of 8 nm and a length of 0.15 μm-3.0 μm. Volumetric percentages of the CNTs ranged from 0.2% by volume to 2.0% by volume of the Al/PTFE energetic material. Volumetric percentages of the GNPs ranged from 0.5% by volume to 4.0% by volume of the Al/PTFE energetic material. The amount of CNTs and/or GNPs used for each corresponding volume percent of carbon nanofiller is shown in Table 1.

TABLE 1

| Volume Percent of Carbon Nanofiller | | | | | | |
|---|---|---|---|---|---|---|
| CNT | | GNP | | GNP/CNT | | |
| Vol. % Added | Mass (mg) | Vol. % Added | Mass (mg) | Ratio of GNP/CNT | Mass GNP (mg) | Mass CNT (mg) |
| 0.2% | 1.8 | 0.5% | 5.6 | 0/100 | 0 | 17.9 |
| 0.5% | 4.5 | 1.0% | 11.2 | 20/80 | 4.5 | 14.3 |
| 1.0% | 8.9 | 2.0% | 22.4 | 40/60 | 8.9 | 10.7 |
| 2.0% | 17.9 | 3.0% | 33.5 | 60/40 | 13.4 | 7.2 |
| | | 4.0% | 44.7 | 80/20 | 17.9 | 3.6 |
| | | | | 100/0 | 22.4 | 0 |

Aluminum (Al) powder with particle sizes of 3 μm-4.5 μm was used as the elemental fuel and polytetrafluoroethylene (PTFE) powder with an average particle diameter of 35 μm was used as the oxidizer. The aluminum and PTFE were purchased from Alfa Aesar (Ward Hill, Mass.). Although a control Al/PTFE energetic material lacking the carbon nanofiller was not ESD sensitive since the Al and PTFE used were μm sized, the carbon nanofiller was added to this baseline formulation to determine whether the energetic material became ESD sensitive as increasing percentages of the carbon nanofiller were present. By adding increasing percentages of the carbon nanofiller to the Al/PTFE energetic material, it was believed that the electrical conductivity of the energetic material would be effected, resulting in a corresponding effect in ESD sensitivity.

A stoichiometric equivalence ratio was prepared for each test based on the elemental fuel and oxidizer particles. Once proportioned, hexane was added to the Al and PTFE powders and sonicated. The Al/PTFE solution was then poured into a PYREX® dish to evaporate the hexane in a fume hood and leave behind the Al/PTFE. The carbon nanofiller was then added by different processes, as described below.

An aqueous dispersant for multi-walled CNTs, purchased from Alfa Aesar (no. 44276), was used to disperse the carbon nanofillers. The carbon nanofillers were added to solutions that included 0.075 mL of the aqueous dispersant and 25 mL of water, which was then sonicated for 1 minute to form nanofiller dispersions. The Al/PTFE was mixed with isopropyl alcohol and added to the carbon nanofiller dispersions and again sonicated for 1 minute. After sonication, the solvents were evaporated, leaving a dry mixture of the Al/PTFE and carbon nanofiller. This process is referred to herein as "short sonication mixing."

The carbon nanofiller was sonicated in distilled water for 30 minutes, allowing for complete dispersion (i.e., no settling of carbon nanofiller was visible in solution). The dispersed solution was then sonicated for 1 minute with the Al/PTFE, and then the water was evaporated. During evaporation, the Al/PTFE settled to the bottom and separated itself from the dispersed carbon nanofiller, which settled on top of the Al/PTFE. The dry powders were dry mixed as they were collected and placed in a storage container. This process is referred to herein as "long sonication mixing."

A slurry was prepared by mixing the CNTs in water. The slurry was immediately placed in a freezer. The frozen slurry was then freeze dried to remove the water. The freeze dried CNTs were dry mixed with the Al/PTFE using a vortex mixer until the CNTs were no longer visible in the powder. This process is referred to herein as "dry mixing."

Scanning electron microscopy (SEM) was used to image the samples of energetic material prepared using the three mixing processes described above and determine the carbon nanofiller dispersion quality. As shown in FIG. 1, Panel a, the short sonication mixing formed a dispersed material with aluminum particles in contact with the larger PTFE particles and CNTs homogeneously dispersed throughout the sample, building a conductive network between the Al and PTFE particles. As shown in FIG. 1, Panel b, the long sonication mixing also provided a good dispersion of CNTs but resulted in more agglomeration due to the separation of CNTs and Al/PTFE during mixing. As shown in FIG. 1, Panel c, the dry mixing resulted in agglomeration of the CNTs throughout the material, such as the representative CNT cluster seen in the center of FIG. 1, Panel c. The SEM images show that the short sonication mixing provided the best dispersion of CNTs and the dry mixing resulted in clumps of aggregated CNTs.

Figure 2:
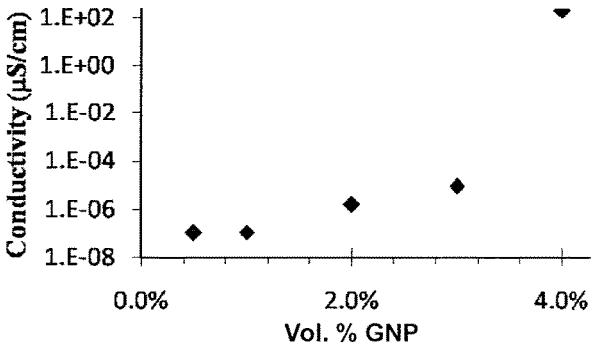
FIGS. 2-7 are graphs depicting the electrical conductivities of energetic materials according to embodiments of the disclosure.

The electrical conductivity of each of the energetic materials was measured by a two-point probing method. The energetic materials were tested for ignition sensitivity from an electrostatic discharge (ESD) using an apparatus built by Franklin Applied Physics. The apparatus had a variable voltage output ranging from 1 kV to 10 kV and charged a 0.002 μF capacitor. The stored electrical energy was discharged through a resistive network and from an electrode pin into the sample of energetic material. The samples had a bulk density of 35% of the theoretical maximal density, which was the same density as was used in the electrical conductivity measurements. Each of the samples was placed on the sample holder disk and the capacitor was lowered towards the pellet to discharge its electric energy. This test has a "go/no go" result, indicating ignition or no ignition of the sample. The electrical conductivity for a control energetic material including only aluminum and PTFE, with no carbon nanofiller, was determined to be $1\times10^{-7}$ μS/cm. FIG. 2 shows the electrical conductivity of the samples as a function of GNP concentration. The electrical conductivity began to increase at 2% by volume of the GNPs, and then increased exponentially, by 7 orders of magnitude, at only 4% by volume of the GNPs. The sharp increase in electrical conductivity consistently occurred between 3% by volume and 4% by volume of the GNP for all three mixing procedures.

Figure 3:
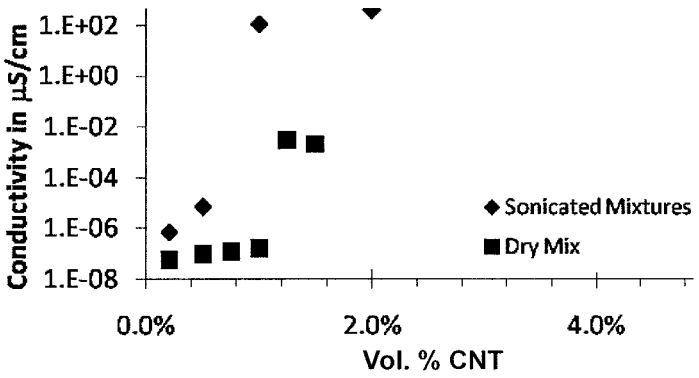

FIG. 3 shows the electrical conductivity as a function of CNT concentration and was consistent for the mixing processes involving sonication (short and long) but different for the dry mixing. For the sonicated mixing (short and long), the electrical conductivity between 0.5% by volume and 1.0% by volume of the CNTs significantly increased by 6.5 orders of magnitude. For the dry mixing, the increase in electrical conductivity occurred between 1.0% by volume and 1.25% by volume of the CNTs. The electrical conductivity of the energetic materials produced by the dry mixing behaved differently than the energetic materials produced by the sonication processes (short and long) in that an electrical conductivity plateau was observed around $2.5\times10^{-3}$ μS/cm and before reaching the maximum conductivity (above 100 μS/cm).

The Al/PTFE with the CNTs experienced an increase in electrical conductivity at lower percentages (between 0.5% by volume and 1.0% by volume for sonication processes and between 1.0% by volume and 1.25% by volume for the dry mixing process) compared to that of the Al/PTFE with the GNPs between 3.0% by volume and 4.0% by volume. The sharp increases in electrical conductivity observed in FIGS. 2 and 3 are a sign of percolation, which is believed to be due to the connectivity of the carbon nanofillers.

Figure 4:
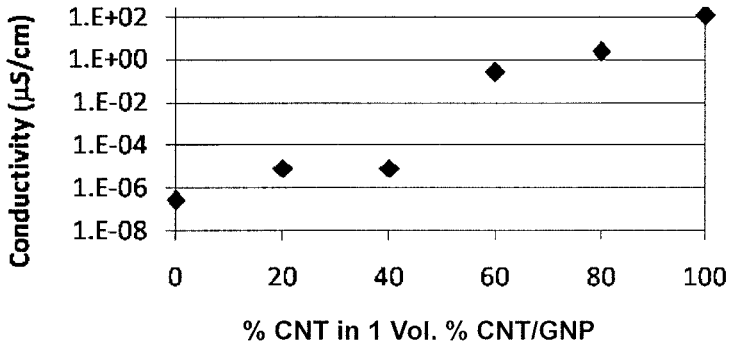

A 1% by volume and 2% by volume of a combination of CNTs/GNPs was added to the Al/PTFE energetic material using the sonication mixing process. The CNT/GNP ratio was varied from 0/100 to 100/0, as shown in Table 1. The electrical conductivity measurements for the 1% by volume CNTs/GNPs combination are shown in FIG. 4. The electrical conductivity of the samples increased as the amount of CNTs used as the carbon nanofiller in the Al/PTFE increased. Therefore, it is believed that the GNPs did not contribute to a rise in electrical conductivity of the Al/PTFE at a concentration of 1% by volume.

Figure 5:
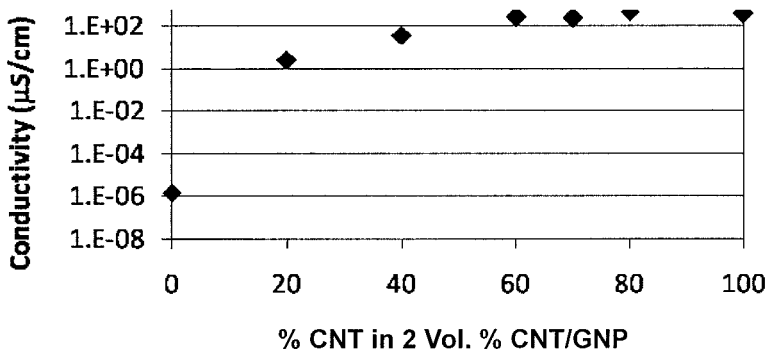

A 2% by volume CNT/GNP was added to the Al/PTFE and the results of the electrical conductivity are shown in FIG. 5. The trend in FIG. 5 was similar to that of FIG. 4 in that the electrical conductivity of the samples increased as the amount of CNT used as the carbon nanofiller increased. However, the largest increase in electrical conductivity occurred at 60% by volume CNTs for the 1% by volume of carbon nanofiller, and at 20% by volume CNTs for the 2% by volume of carbon nanofiller. The percolation threshold corresponding with the volumetric percent of CNTs used in these energetic materials occurred between 0.4% by volume and 0.6% by volume and is consistent with FIG. 3 (i.e., Al/PTFE with only CNTs added). Without being bound to any theory, it is believed that the CNTs in the Al/PTFE energetic material behaved differently than the GNPs in that the CNTs wrap around aluminum and PTFE particles and link together, creating a conductive network throughout the energetic material as seen in FIG. 1, Panel a.

Figure 6:
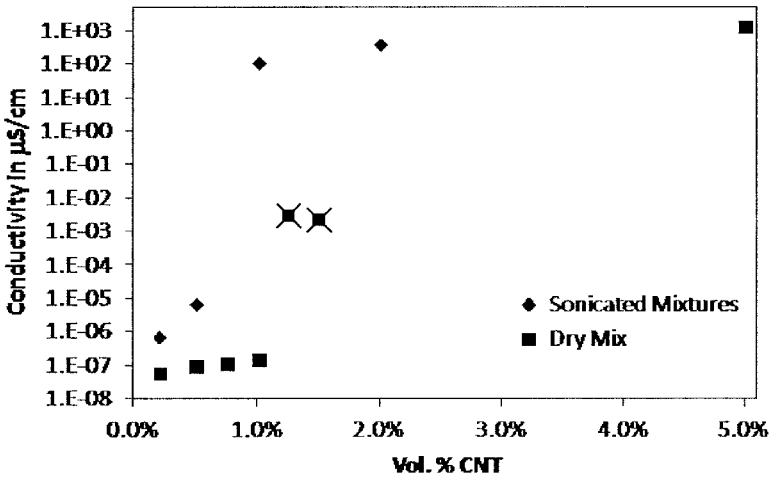

The Al/PTFE and carbon nanofiller energetic materials were further examined for ESD ignition sensitivity, as shown in FIG. 6. The ESD ignition sensitivity was determined by conventional techniques, which are not described in detail herein. The maximum voltage used to create a spark through the samples was 10 kV and corresponded to 100 mJ of energy. All the samples for the two mixing processes involving sonication resulted in no ignition, but the samples prepared by the dry mixing process with 1.25% by volume and 1.5% by volume of CNTs ignited below 100 mJ and, therefore, were deemed ESD ignition sensitive. The average electrical conductivities of the ESD sensitive samples were $2.8\times10^{-3}$ μS/cm and $2.2\times10^{-3}$ μS/cm, respectively. These values are located within an electrical conductivity region previously reported for an aluminum and copper oxide energetic material that was shown to be ESD ignition sensitive only within the conductivity limits between $8.8\times10^{-4}$ μS/cm and $1.2\times10^{-2}$ μS/cm. The data points in FIG. 6 marked with an "X" indicate the energetic materials that resulted in ignition from ESD.

As shown in FIG. 6, the energetic materials with a low electrical conductivity are not ignition sensitive to ESD (conductance (G) and resistance (R) are inversely proportional (power (P)=$V^2/R=V^2-G$, where V is the voltage)). An energetic material with low electrical conductivity resulted in low power absorbed by the energetic material, which implied that the energy delivered to the energetic material did not reach the minimum energy required for ignition. As percolation is achieved with increasing concentration of CNTs, the electrical conductivity increased and the power absorbed by the material also increased. Without being bound by any theory, the energetic materials with high electrical conductivity (around 100 μS/cm) did not ignite because current traveled through the carbon nanofiller and bypassed the Al/PTFE of the energetic material.

The above results demonstrated that carbon nanofillers, such as CNTs, GNPs, and combinations thereof, can be used to tailor the ESD ignition sensitivity of an energetic material. Results showed that the presence of CNTs in the energetic material were the predominant factor in affecting electrical conductivity and ESD ignition sensitivity. The effect of the CNTs is believed to be due to their morphology, which wraps around elemental fuel and oxidizer particles. Without being bound by any theory, it is believed that the CNTs provided improved connectivity of the carbon nanofillers throughout the energetic material. In fact, the electrical conductivity of a control Al/PTFE composition was $1\times10^{-7}$ μS/cm and the electrical conductivity was found to significantly increase, by almost 10 orders of magnitude, to a conductivity of 100 μS/cm with the addition of only 4% by volume GNPs and 1% by volume CNTs to the energetic material. When a combination of CNT/GNP carbon nanofillers was tested, the low volumetric percentages of CNTs created an increase in the electrical conductivity, controlling the percolation threshold. The energetic materials with a high electrical conductivity did not ignite because the current traveled through the carbon nanofillers, bypassing heating and ignition of the energetic material. Al/PTFE energetic materials having an electrical conductivity around 0.002 μS/cm did ignite and showed that a correlation exists between electrical conductivity and ESD ignition sensitivity.

Example 2

Al/CuO Energetic Materials

Figure 7:
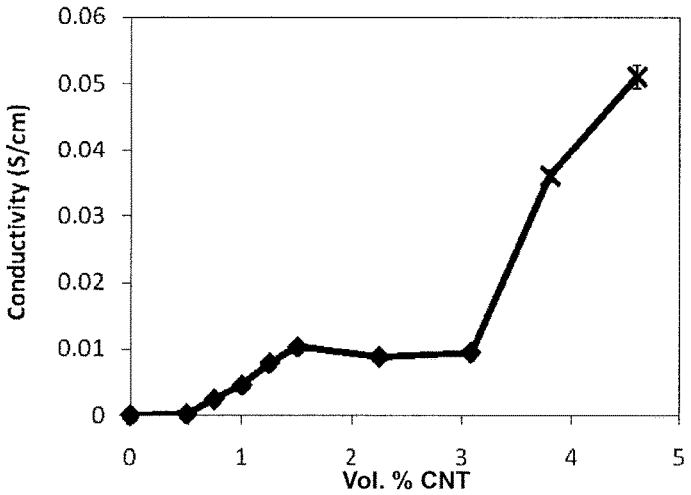

Energetic materials including nanopowder aluminum, copper(II) oxide, and CNTs were prepared. The energetic material had an F/O ER of 1. The CNTs were added at volumetric percentages ranging from 0.5% by volume to 4.6% by volume. The electrical conductivity was determined for each of the energetic materials. As shown in FIG. 7, energetic materials having less than or equal to about 3% by volume of the CNTs were ESD sensitive. However, the energetic materials having 3.8% by volume and 4.6% by volume of the CNTs, indicated in FIG. 7 with "X's," were not ESD sensitive.

Example 3

$Al/KClO_4$ Energetic Materials

Energetic materials including aluminum powder and potassium perchlorate were prepared. The energetic materials included between about 25% by weight and about 30% by weight aluminum powder and between about 65% by weight and about 70% by weight potassium perchlorate. Carbon fiber rods were added at 1% by volume and 5% by volume. The carbon fiber rods were purchased from Toho Tenax America (Rockwood, Tenn.) under the TENAX® trade name (type PLS012). The energetic materials were prepared by mixing the aluminum powder, potassium perchlorate, and carbon fiber rods.

Figure 8:
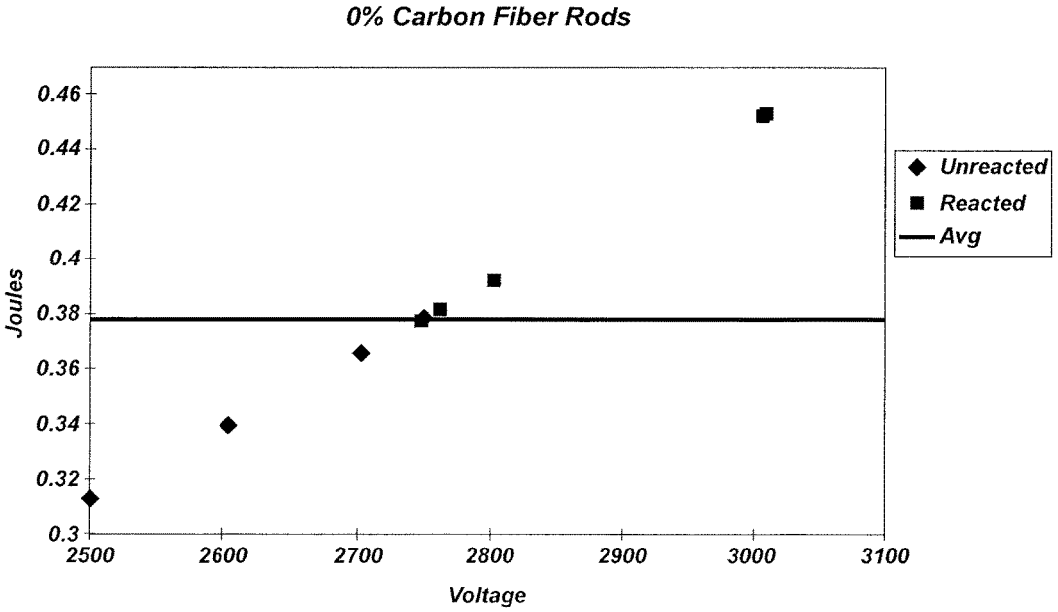
FIGS. 8-10 are graphs depicting the average energy utilized to ignite energetic materials according to embodiments of the disclosure.
Figure 9:
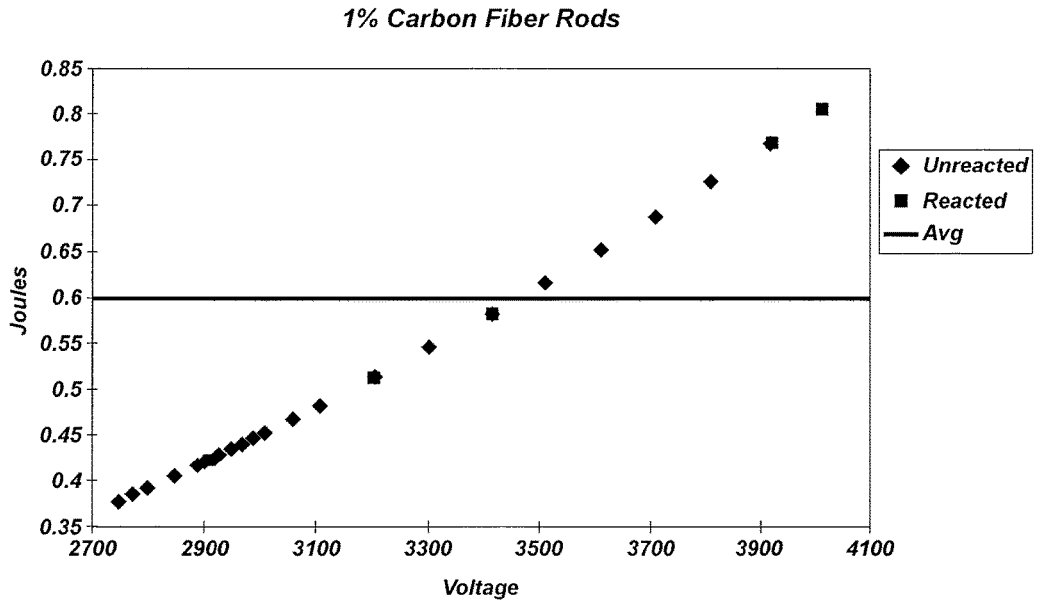
Figure 10:
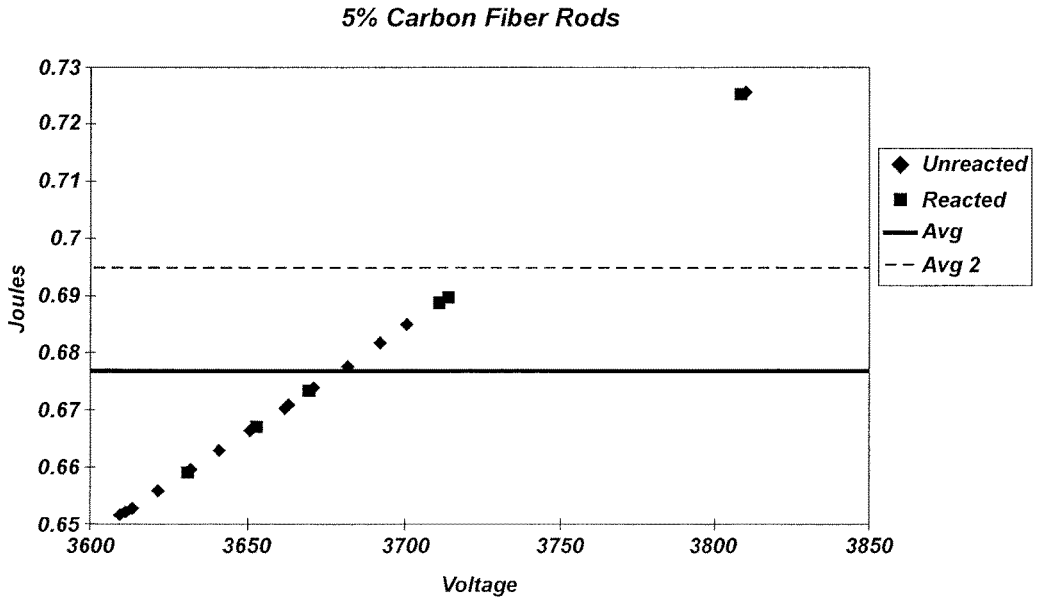

The amount of energy needed to ignite each energetic material was determined, including for a control energetic material lacking the carbon fiber rods. As shown in FIG. 8, an energetic material including about 30 wt % aluminum and about 70 wt % potassium perchlorate, but lacking the carbon fiber rods, utilized an average energy of 0.378 Joules to ignite the energetic material. As shown in FIG. 9, the energetic material including the aluminum powder, potassium perchlorate, and 1% by volume of the carbon fiber rods utilized an average energy of 0.599 Joules to ignite the energetic material. As shown in FIG. 10, an energetic material including the aluminum powder, potassium perchlorate, and 5% by volume of the carbon fiber rods utilized an average energy of 0.677 Joules to ignite the energetic material. Thus, as the percentage of carbon fibers in the energetic materials increased, the average energy needed to ignite the energetic materials also increased.

Example 4

Al/CuO/CNT/AN Energetic Materials

Energetic materials including aluminum (Al), copper oxide (CuO), CNTs, and ammonium nitrate (AN) were prepared. The energetic materials were similar to those described in Example 1 except the energetic materials had an F/O ER of 1.6, 1.7, 1.8, 2.2, 2.3, 2.5, 3.0, 3.5, 4.0, 4.5, 5.0, 5.5, and 6.0, and equal mole fractions of AN were used in place of a portion (50%) of the CuO. The CNTs were multi-walled carbon nanotubes having an outer diameter of 20 nm, an inner diameter of 3 nm, and a length varying from 0.1-10 microns (μm). The Al was a powder having an average spherical particle diameter of 4.0 microns. The CuO was a powder having an average spherical particle diameter of 50 nm. The AN was a powder. All powders were procured from Alpha Aesar (Ward Hill, Mass.).

The Al, CuO, CNTs, and AN were suspended in hexane and sonicated in a Misonix S3000 sonicator for a total of one minute in ten second intervals. After sonication, the mixtures were poured into a PYREX® dish and the hexane evaporated while in a fume hood. The AN was incorporated into the energetic materials at varied concentrations and the energetic materials were evaluated for ignition and combustion when heated at slow and fast rates. The slow rate simulated fire conditions and the fast rate was used to simulate ignition conditions of the energetic material. Experiments were designed to examine various stoichiometric proportions of CuO and AN with Al as shown in the following reaction:

$$3CuO+3NH_4NO_3+4Al \rightarrow 2Al_2O_3+3Cu+3N_2+6H_2O \qquad \text{Reaction 1}$$

As shown in Reaction 1, for every mole of CuO removed from the energetic material, about 1.0096 moles of AN was added such that a 1:1 ratio of CuO:AN kept the oxygen concentration of the energetic material constant.

For each tested F/O ER, two samples of the energetic material were prepared: (1) a baseline composition including Al, CuO, and CNTs, and (2) an AN-containing composition including Al, CuO, CNTs, and AN, so that the ignition and combustion of the AN-containing composition could be compared to that of the baseline composition. Three stages of experiments were conducted and the experiments were performed in triplicate to establish reproducibility.

Figure 11:
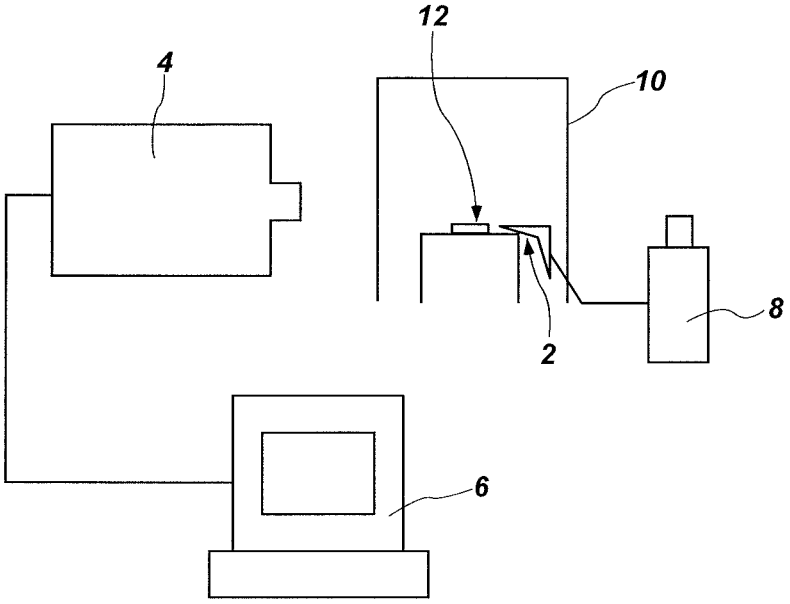
FIG. 11 is a schematic illustration of an apparatus used to evaluate ignition and combustion of energetic materials according to embodiments of the disclosure.

In a first stage of experiments, energetic materials at the different F/O ER were evaluated for combustion (i.e., energetic reactivity) using an apparatus as illustrated in FIG. 11. The apparatus included a hot wire 2, a high speed camera 4, associated software 6, a variable voltage source 8, and a blast chamber 10 to house a sample 12. A 50 mg powder sample for each F/O ER was ignited with the hot wire 2, which provided a heating rate in excess of $1\times10^6$ DPM and the combustion was recorded using the high speed camera 4. The variable voltage source 8 was used to apply 15 volts to the hot wire 2 in order to achieve the temperature needed for ignition. The hot wire 2 was a Nichrome wire igniter. The high speed camera 4 was a Phantom v7 (Vision Research) high speed camera and was used to record the combustion event using an F-Stop of 25 and captured images at 10,000 frames per second. The samples at the different F/O ER were ignited using the hot wire 2. The ability to ignite of the samples at the different F/O ER are reported in Table 2 in the "Pre-Heat Ignition" column.

In a second stage, energetic materials at the various F/O ER were exposed to fire conditions. A 50 mg sample for each F/O ER was heated under simulated accidental fire conditions using a vacuum oven (NeyTech Qex) in an air environment. The samples were heated at 10 DPM from room temperature (about 20° C. to about 25° C.) to 230° C. and held at 230° C. for 1 hour, then cooled to room temperature. An InstruNet (model 100) data acquisition board and InstruNet software were used to record the temperature. The 230° C. temperature was selected to be above the decomposition temperature of AN so that the effects of AN decomposition on combustion could be evaluated.

In a third stage, the ignition and combustion of the energetic materials at the various F/O ERs were evaluated after being heated at the fast rate of the simulated fire. A 50 mg sample for each F/O ER was ignited as described above in the first stage, and the combustion (i.e., energetic reactivity) was recorded using the apparatus of FIG. 11 and the same operating conditions of the first stage. The ability to ignite of the samples at the different F/O ER are reported in Table 2 in the "Post-Heat Ignition" column.

The results for the combustion (i.e., energetic reactivity) as a function of F/O ER are shown in Table 2, where the "Pre-Heat Ignition" column describes whether or not the energetic material combusted following the first stage, and the "Post-Heat Ignition" column describes whether or not the energetic material combusted following the third stage. The "Comments" column provides visual observations during the testing.

TABLE 2

Ignition and Combustion of Energetic Materials at Different F/O ER.

| F/O ER | Pre-Heat Ignition (First Stage) | Post-Heat Ignition (Third Stage) | Comments |
|---|---|---|---|
| 1.6 | YES | N/A | Ignited during bake |
| 1.7 | YES | YES | |
| 1.8 | YES | YES | |
| 2.2 | YES | YES | |
| 2.3 | YES | YES | |
| 2.3 (AN Only) | YES | NO | Complete AN decomposition preventing post-heat treatment ignition |
| 3.0 | YES | YES | |
| 3.5 | YES | NO/YES | Non-repeatable results |
| 4.0 | YES | NO | Small amount of propagation but not self-sustained |
| 4.5 | YES | NO | Almost no propagation |
| 5.0 | YES | NO | No propagation but powder was red hot and turned to ash |
| 5.5 | YES | NO | Similar to ER = 5.0 but powder pile exhibited slower heating |
| 6.0 | YES | NO | Similar to ER = 5.5 but even slower. No visible flame. |

A desirable energetic material is one that did not ignite post-heat treatment (exposure to fire conditions) of the second stage. As shown in Table 2, the energetic materials at each of the tested F/O ERs showed ignition with no pre-heat treatment. These samples ignited easily but exhibited different burn behavior compared to the baseline compositions. The baseline compositions ignited easily and in an energetic manner, exhibited more gas generation, and burnt more quickly than the pre-heat ignition samples. In addition, the energetic materials having an F/O ER of below 4.0 ignited after being heated by the fire conditions. However, at an F/O ER of greater than or equal to 4.0, the energetic materials did not ignite following exposure to the simulated fire conditions. These post-heat ignition samples also had little propagation. Thus, the F/O ER of greater than or equal to 4.0 was determined to be the threshold for activating decomposition of the AN when 50% of the CuO was replaced with the AN. The energetic materials having an F/O ER of between 4.5 and 5.5 and exposed to the conditions simulating a fire had almost no reaction to the ignition conditions, which is believed to be due to decomposition of the AN.

Figure 12A:
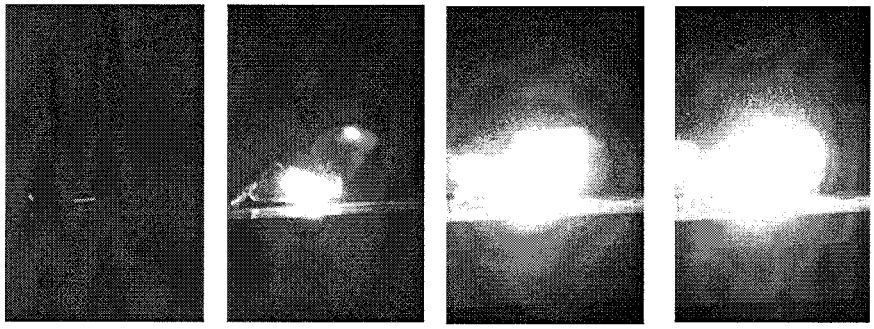
FIGS. 12A-12C are still frame images showing the ignition and combustion of energetic materials having an F/O ER of 4.0 where (A) shows that of a baseline composition (Al/CuO/CNT), (B) shows that of an AN-containing composition (Al/CuO/CNT/AN) pre-heat ignition, and (C) shows that of an AN-containing composition (Al/CuO/CNT/AN) post-heat ignition.
Figure 12B:
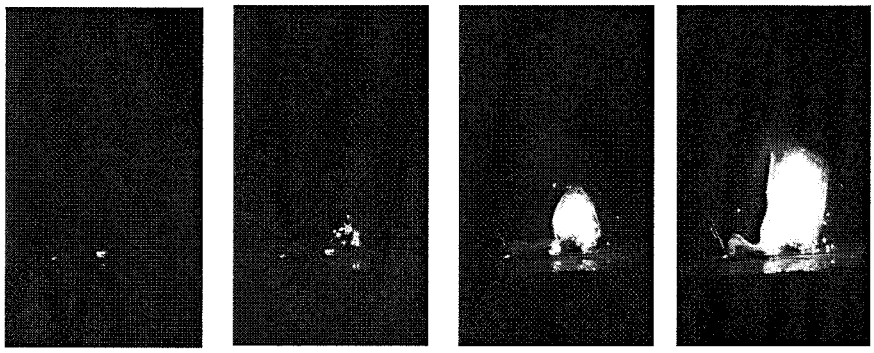
Figure 12C:
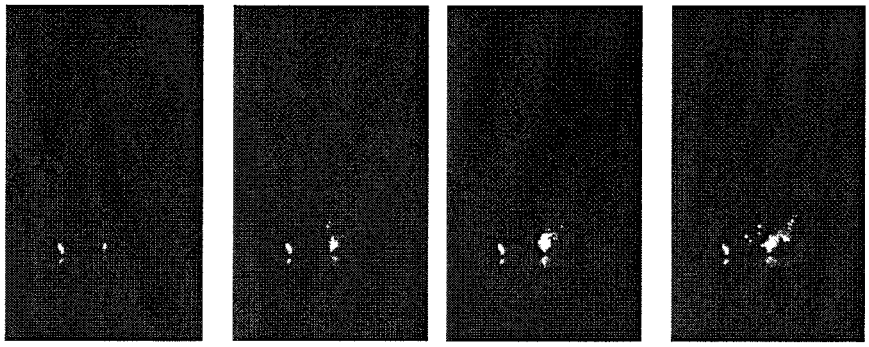

All of the samples that included AN demonstrated comparable visual combustion to the baseline compositions at the corresponding F/O ER. Thus, it was determined that the AN in the energetic material effectively replaced CuO in 1:1 molar ratios and maintained comparable combustion behavior. FIGS. 12A-12C are still frame images of tested samples having an F/O ER of 4.0. As shown in FIGS. 12A and 12B, the baseline composition (FIG. 12A) including Al, CuO, and CNTs and the AN-containing composition (FIG. 12B) including Al, CuO, CNTs, and AN had a similar exothermicity of reaction. Both of these samples were not exposed to post-heat ignition (i.e., fire conditions). In comparison, the AN-containing composition that was exposed to the post-heat ignition (i.e., fire conditions) (FIG. 12C) did not achieve a self-sustained reaction and resulted in nearly 80% incomplete reaction as determined by post DSC analysis of unreacted Al melting. The energetic material having the F/O ER of 4.0 repeatedly provided unsustained propagation and non-ignition. These results showed that the AN-containing compositions having the F/O EO ranging from 4.0 to 5.5 inerted the energetic material when heated at the slow rate, yet ignited with comparative combustion performance to the baseline composition when heated at the fast rate.

Figure 13A:
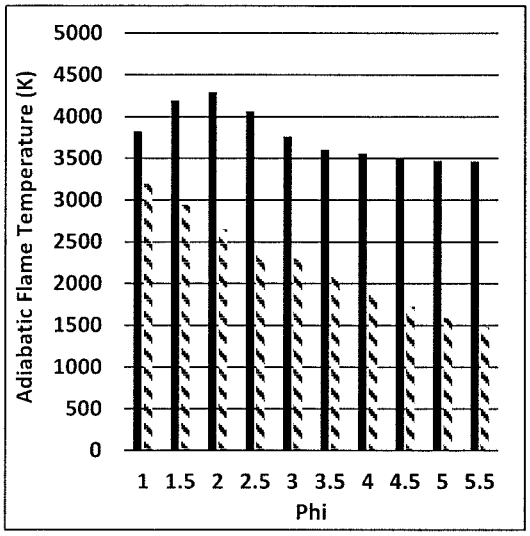
FIGS. 13A and 13B are graphs depicting the calculated adiabatic flame temperature and heat of combustion as a function of fuel/oxidizer equivalence ratio.
Figure 13B:
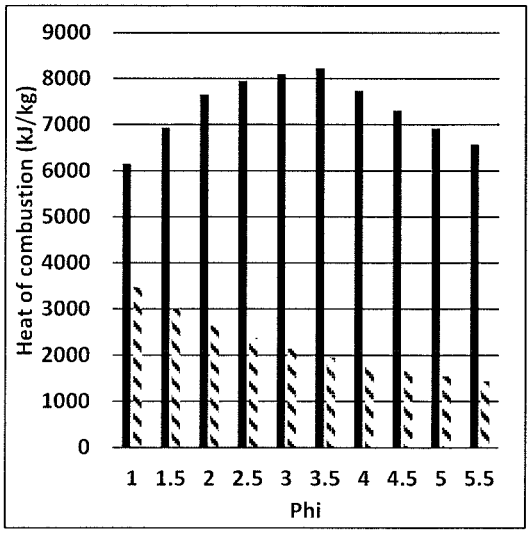

Thermal chemical calculations for Reaction 1 were performed using REAL code simulation software (Timtec L.L.C.) for constant volume conditions. Adiabatic flame temperature and heat of combustion as a function of F/O ER (ranging from 1.0-5.5) were simulated, as shown in FIGS. 13A and 13B. In FIGS. 13A and 13B, solid bars represent the energetic materials pre-heat ignition and hatched bars represent the energetic materials post-heat ignition. In the post-heat treated samples, the assumption was that AN did not participate in the reaction such that the products $H_2O$ and $N_2$ do not exist. The simulations indicated that post-heat treatment decomposition of AN rendered the reaction excessively fuel rich such that flame temperatures dropped below the limit for a self-sustaining propagation, identified as 2000K. In fact, for an F/O ER of 4.0 the flame temperature dropped just below 2000K, consistent with experimental observations of limited reactivity for that formulation (see FIG. 12C). Pre-heat ignition flame temperatures and heats of combustion were comparable for all formulations examined, such that these simulations were also an indication that AN did not significantly reduce the reactivity of the baseline composition.

Figure 14:
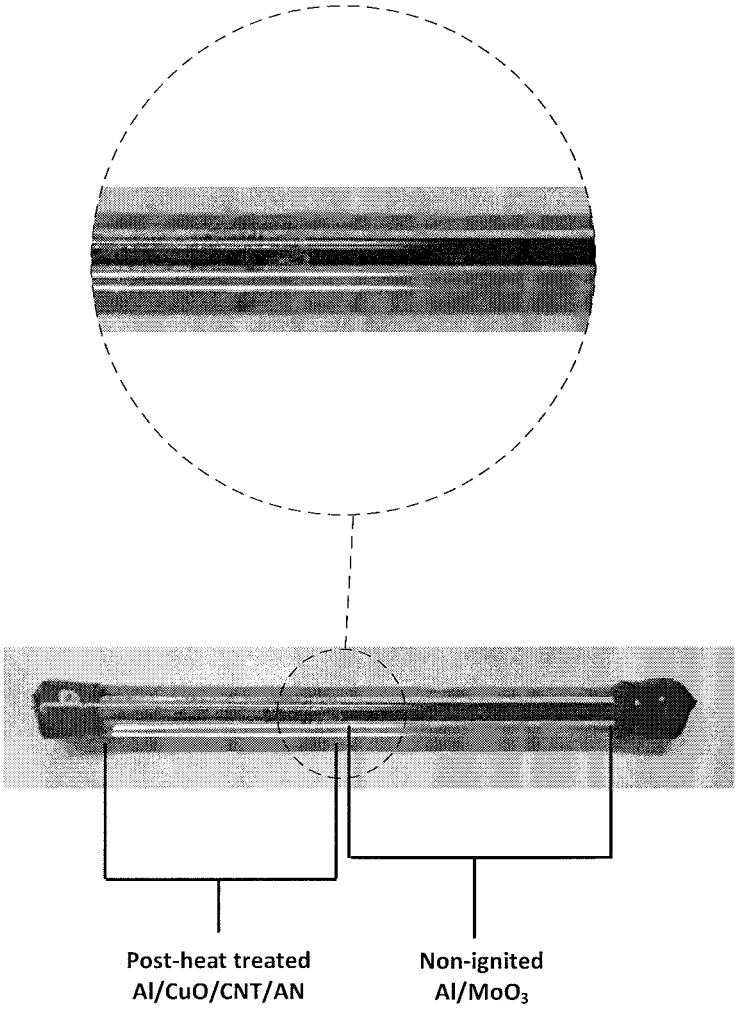
FIG. 14 is a photograph of a flame tube apparatus in which a post-heat ignition sample of the AN-containing composition was used to determine ignitability of an ignition sensitive thermite composition.

The energetic materials having an F/O ER of 4.0 and 4.5, which successfully ignited pre-heat treatment but did not ignite post-heat treatment, were tested for their ability to ignite an ignition sensitive energetic material. These energetic materials were tested used a flame tube apparatus having a tube that is 10 cm long with a 5 mm inside diameter as shown in FIG. 14. One-half of the tube was filled with 125 mg of the pre- or post-heat ignition sample and the other half was filled with 125 mg of nano-scale particles of aluminum and molybdenum trioxide ($Al/MoO_3$), which is known in the art to be one of the most ignition sensitive compositions. Before testing, the pre-heat ignition samples were placed in desiccant for 48 hours to remove moisture. The pre-heat ignition samples of the energetic materials having an F/O ER of 4.0 successfully ignited the $Al/MoO_3$ composition while, as shown in FIG. 14, the post-heat ignition sample having an F/O ER of 4.0 did not ignite the $Al/MoO_3$ composition. The $Al/MoO_3$ composition in the right side of the tube remained in powder form, indicating that the post-heat ignition sample having an F/O ER of 4.0 did not ignite the $Al/MoO_3$ composition. However, the pre-heat ignition sample having an F/O ER of 4.0 and the baseline composition did ignite the $Al/MoO_3$ composition (results not shown). An enlarged view of the junction of the post-heat ignition sample and the $Al/MoO_3$ composition is shown as an inset to FIG. 14.

Example 5

Additional Tested Additives

The ability of aluminum stearate, copper carbonate, lithium 12-hydroxystearate, strontium oxalate, sulfur, zinc peroxide, and zinc stearate as additives was evaluated by measuring their melting points, decomposition temperature, and water solubility. Results are shown in Table 3.

TABLE 3

Evaluation of Additional Additives.

| Additive | Formula | Melting point (° C.) | Decomposes (° C., Yes, No) | Water solubility |
|---|---|---|---|---|
| Aluminum stearate | $C_{54}H_{105}AlO_6$ | 150 | | Insoluble |
| Copper carbonate | $CuCO_3$ | 200 | 290 | Insoluble |
| Lithium 12-hydroxystearate | $C_{18}H_{35}LiO_3$ | 200 | | Insoluble |

TABLE 3-continued

Evaluation of Additional Additives.

| Additive | Formula | Melting point (° C.) | Decomposes (° C., Yes, No) | Water solubility |
|---|---|---|---|---|
| Strontium oxalate | $SrC_2O_4$ | 200 | 200 | Insoluble |
| Sulfur | S | 388 | No | Insoluble |
| Zinc peroxide | $ZnO_2$ | 212 | 150 | Insoluble |
| Zinc stearate | $C_{36}H_{70}O_4Zn$ | 120 | Yes | Insoluble |

Of the tested additives, zinc stearate exhibited the most favorable behavior. The zinc stearate was mixed with the Al/CuO/CNT energetic material in its liquid form and allowed to cool. The zinc stearate functioned as a binder, but allowed the energetic material to ignite normally. Above 120° C., the zinc stearate melted and became a low viscosity liquid that wetted the Al and CuO, preventing ignition. Above its decomposition temperature, the zinc stearate left behind a crusted carbon residue that also inhibited the thermite reaction of the energetic material. Unlike the AN, the above-tested additives did not contribute to the thermite reaction. However, in humid environments or when a binder is needed, one of the above-tested additives may be used instead of the AN.

While the disclosure may be susceptible to various modifications and alternative forms, specific embodiments have been shown by way of example in the Examples and drawings and have been described in detail herein. However, it should be understood that the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A method of reducing ignition sensitivity of an energetic material, the method comprising:

combining an additive, an elemental fuel, and a metal oxide to form an energetic material; and heating the energetic material to a temperature between about 150° C. and about 300° C. at a slow rate to decompose the additive and to render the energetic material inert to ignition while the energetic material is formulated to be ignitable when directly heated at a fast rate.

2. The method of claim 1, wherein combining an additive, an elemental fuel, and a metal oxide to form an energetic material comprises combining an additive having a decomposition temperature of less than an autoignition temperature of the energetic material with the elemental fuel and the metal oxide.

3. The method of claim 1, wherein combining an additive, an elemental fuel, and a metal oxide to form an energetic material comprises combining an additive having a decomposition temperature of less than about 290° C. with the elemental fuel and the metal oxide.

4. The method of claim 1, wherein combining an additive, an elemental fuel, and a metal oxide to form an energetic material comprises combining an additive selected from the group consisting of ammonium nitrate, aluminum stearate, copper carbonate, lithium 12-hydroxystearate, strontium oxalate, sulfur, zinc peroxide, zinc stearate, and combinations thereof with the elemental fuel and the metal oxide.

5. The method of claim 1, wherein combining an additive, an elemental fuel, and a metal oxide to form an energetic material comprises combining ammonium nitrate with the elemental fuel and the metal oxide.

6. The method of claim 1, wherein combining an additive, an elemental fuel, and a metal oxide to form an energetic material comprises combining ammonium nitrate, aluminum, and copper oxide to form the energetic material.

7. The method of claim 1, wherein heating the energetic material to a temperature between about 150° C. and about 300° C. at a slow rate to render the energetic material inert to ignition comprises heating the energetic material at a rate of less than about 100 degrees Celsius per minute.

8. A method of reducing ignition sensitivity of an energetic material, the method comprising:

heating an energetic material to a temperature between about 150° C. and about 300° C. at a slow rate of less than about 100 degrees Celsius per minute, the energetic material comprising an elemental fuel, a metal oxide, and an additive selected from the group consisting of ammonium nitrate, aluminum stearate, copper carbonate, lithium 12-hydroxystearate, strontium oxalate, sulfur, zinc peroxide, zinc stearate, and combinations thereof; and heating the energetic material previously heated at the slow rate at a fast rate of greater than or equal to about 100 degrees Celsius per minute, wherein the energetic material previously heated at the slow rate does not ignite.

9. The method of claim 1, wherein heating the energetic material to a temperature between about 150° C. and about 300° C. at a slow rate to render the energetic material inert to ignition comprises increasing the fuel/oxidizer equivalence ratio of the energetic material.

10. The method of claim 1, wherein heating the energetic material to a temperature between about 150° C. and about 300° C. at a slow rate to render the energetic material inert to ignition comprises exposing the energetic material to heat produced by a fire.

11. The method of claim 1, wherein heating the energetic material to a temperature between about 150° C. and about 300° C. at a slow rate to render the energetic material inert to ignition comprises reacting the additive with the elemental fuel to produce an amount of energy below an autoignition temperature of the energetic material.

12. The method of claim 1, wherein combining an additive, an elemental fuel, and a metal oxide to form an energetic material comprises combining an amount of the additive with the elemental fuel and the metal oxide such that a combined amount of the metal oxide and the additive exhibits a fuel/oxidizer equivalence ratio for the energetic material of from about 4.0 to about 5.5.

13. The method of claim 8, wherein the fast rate comprises a heating rate of greater than or equal to about $1\times10^6$ degrees Celsius per minute.

14. The method of claim 1, wherein combining an additive, an elemental fuel, and a metal oxide to form an energetic material comprises combining ammonium nitrate, aluminum, and copper oxide, and a combined amount of the copper oxide and the ammonium nitrate exhibits a fuel/oxidizer equivalence ratio of from about 4.0 to about 5.5.

15. The method of claim 1, further comprising combining a carbon nanofiller with the additive, elemental fuel, and metal oxide.

16. The method of claim 1, wherein combining an additive, an elemental fuel, and a metal oxide to form an energetic material comprises forming the energetic material consisting of aluminum, copper oxide, and ammonium nitrate.

17. The method of claim 1, wherein combining an additive, an elemental fuel, and a metal oxide to form an energetic material comprises combining aluminum, copper oxide, ammonium nitrate, and at least one of carbon nanotubes and graphene nanoplatelets.

18. A method of reducing ignition sensitivity of an energetic material, the method comprising:

heating an energetic material to a temperature between about 150° C. and about 300° C. at a rate of less than about 100 degrees Celsius per minute, the energetic material comprising an elemental fuel, a metal oxide, and an additive selected from the group consisting of aluminum stearate, copper carbonate, lithium 12-hydroxystearate, strontium oxalate, sulfur, zinc peroxide, zinc stearate, and combinations thereof; and heating the energetic material previously heated at the rate of less than about 100 degrees Celsius per minute at a rate of greater than or equal to about 100 degrees Celsius per minute, wherein the energetic material previously heated at the rate of less than about 100 degrees Celsius per minute does not ignite.

* * * * *